United States Patent [19]

Iwasa et al.

[11] 4,187,774

[45] Feb. 12, 1980

[54] ELECTROSTATIC PRINT MARKING APPARATUS

[75] Inventors: Masakazu Iwasa; Hisashi Kato; Yoshio Kudo, all of Tokyo, Japan

[73] Assignee: Fuji Photo Film Co., Ltd., Minami-ashigara, Japan

[21] Appl. No.: 886,447

[22] Filed: Mar. 14, 1978

[30] Foreign Application Priority Data

Mar. 15, 1977 [JP] Japan ..... 52-28364

[51] Int. Cl.[2] ..... G03G 15/00

[52] U.S. Cl. ..... 101/1; 355/3 TR; 101/41

[58] Field of Search ..... 101/1 R, DIG. 13, 35, 101/36, 41; 355/3 TR

[56] References Cited

U.S. PATENT DOCUMENTS

| | | | |
|---|---|---|---|
| 3,504,625 | 4/1970 | Childress | 101/35 X |
| 3,734,015 | 5/1973 | Camis et al. | 101/DIG. 13 X |
| 3,741,117 | 6/1973 | Bienert et al. | 101/DIG. 13 X |
| 4,048,921 | 9/1977 | Raschke | 101/DIG. 13 X |
| 4,144,808 | 3/1979 | Iwasa et al. | 355/3 TR X |

FOREIGN PATENT DOCUMENTS

| | | | |
|---|---|---|---|
| 2219747 | 10/1973 | Fed. Rep. of Germany | 355/3 TR |

*Primary Examiner*—E. H. Eickholt

[57] ABSTRACT

In an electrostatic print marking apparatus for printing markings on steel plates wherein an intermediate image carrying medium is used for transferring a toner image from an electrostatic image recording drum to a steel plate, a toner image transferred from the drum to the intermediate image carrying medium is re-charged before it is transferred from the image carrying medium to the steel plate.

2 Claims, 1 Drawing Figure

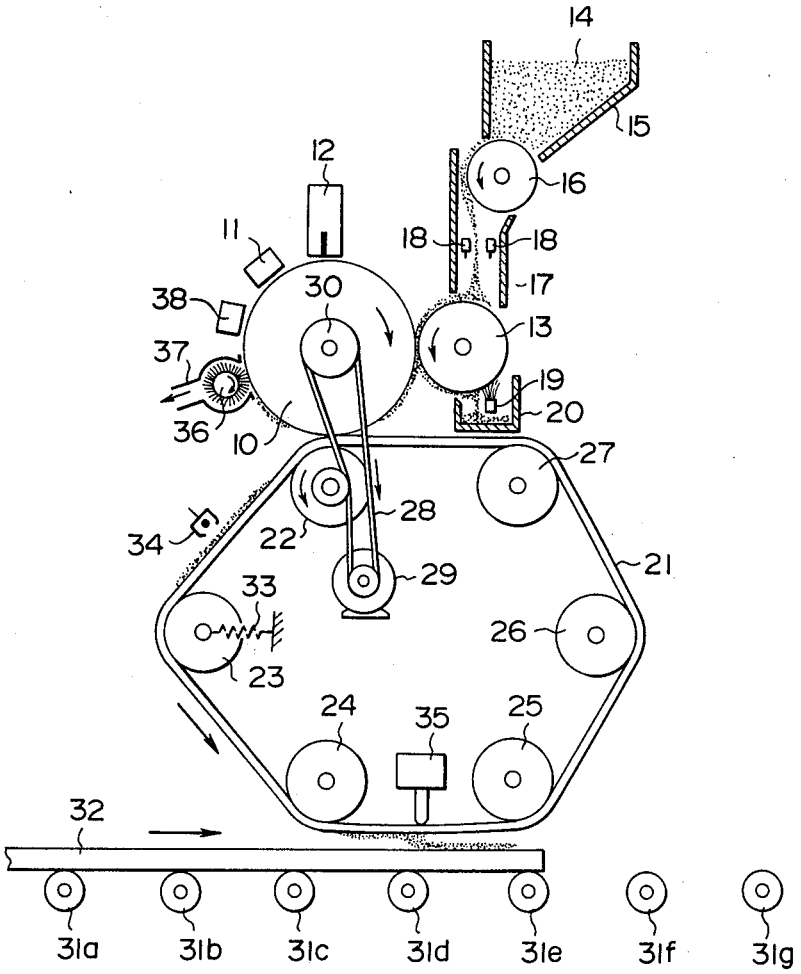
14
15
16
12
11
18
18
17
30
38
13
37
19
20
36
10
27
28
34
22
21
29
33
26
23
24
35
25
32
31a
31b
31c
31d
31e
31f
31g

ELECTROSTATIC PRINT MARKING APPARATUS

BACKGROUND OF THE INVENTION

1. Field of the Invention

This invention relates to a marking apparatus for printing markings on a substrate, and more particularly to an improvement in an electrostatic print marking apparatus.

2. Description of the Prior Art

It has been proposed by the inventors of the present invention to electrostatically print markings on rolled steel plates. Various kinds of information such as the name of the manufacturer, the destination of shipment, dimensions of the plate and so forth are printed in the form of markings on the successively manufactured steel plates fed out of a rolling mill. In a rolling mill, the rolled steel plates leave the rolling rolls in a heated condition. Therefore, in the process already proposed by the inventors, an intermediate image carrying medium is provided between the steel plate on which marking is to be finally printed and an electrostatic image recording member (drum or belt) so that a toner image formed on the recording member is first transferred to the intermediate image carrying medium and then to the steel plate. Thus, the electrostatic recording portion and the developing portion of the apparatus are protected from heat and mechanical vibration.

In the above described print marking apparatus, a high voltage is applied between the steel plate and the intermediate image carrying medium in order to effectively transfer the toner image from the intermediate image carrying medium to the steel plate. The strength of the electrostatic force effected between the image carrying medium and the steel plate to facilitate the transfer of the toner image is determined by the strength of the electric field and the strength of the charge carried by the toner particles. Therefore, the higher is the strength of the charge carried by the toner particles, the easier it becomes to transfer the toner image to the steel plate. Further, when the toner particles are sufficiently charged, the toner particles are prevented from scattering widely over the steel plate and accordingly the resolution of the image obtained on the steel plate is improved. The high voltage applied between the steel plate and the intermediate carrying medium in the above described print marking apparatus enhances the sharpness of the image obtained on the steel plate.

Nevertheless, as the toner image is transferred twice in the above described print marking apparatus, this apparatus suffers from a defect in that the charge of the toner particles is neutralized or weakened in the first transfer process, which results in lowering of the electrostatic force effected in the step of the second transfer of the toner image from the image carrying medium to the steel plate. The neutralization or the weakening of the electrostatic charge carried by the toner particles is caused by the discharge occurring in the step of the first transfer of the toner image from the electrostatic recording material to the intermediate image carrying medium. By the discharge, corona ions are generated and neutralize or weaken the charge carried by the toner particles.

SUMMARY OF THE INVENTION

It is, therefore, the primary object of the present invention to provide a print marking apparatus in which the toner image of the marking is easily transferred to the substrate on which the marking is to be finally printed.

Another object of the present invention is to provide a print marking apparatus in which the marking is printed on a substrate with a high resolution.

The above objects of the present invention are accomplished by charging the toner image which is once transferred to the intermediate image carrying medium from the electrostatic image recording member. That is, the toner image is charged again after the step of the first transfer of the toner image so that the toner image will have a sufficient charge in the step of the second transfer thereof. Thus, the toner image is easily transferred from the intermediate image carrying medium to the steel plate and an image of high resolution is obtained on the steel plate.

BRIEF DESCRIPTION OF THE DRAWING

The single FIGURE is a vertical view partly in section of an embodiment of the print marking apparatus in accordance with the present invention.

DESCRIPTION OF THE PREFERRED EMBODIMENT

Referring to the drawing, an image recording drum 10 is used as an electrostatic image recording material for carrying an electrostatic latent image which is developed into a toner image and transferred to an intermediate image carrying medium, i.e. a transfer belt 21 described hereinafter. The image recording drum 10 is a metallic drum, which may be replaced by a metallic belt, carrying a dielectric layer thereon. The image recording drum 10 is uniformly charged in advance by a DC charger 11. Then, the drum 10 is recorded with an electrostatic latent image by means of a set of discharge electrodes 12 which charges the surface of the drum 10 in the opposite polarity to that of the polarity in which the drum 10 is uniformly charged in advance. Since the drum 10 is pre-charged by the DC charger 11 in the opposite polarity to that of the electrostatic latent image, the effective potential of the latent image can be raised by the level of the pre-charge. Thus, the voltage of the discharge electrodes 12 can be lowered. Normally, the drum 10 is pre-charged with a negative voltage and imagewisely charged with a positive voltage by the discharge electrodes 12.

The set of discharge electrodes 12 are arranged in a line parallel to the axis of rotation of the drum 10 at equal intervals and are supplied with a voltage in the form of pulses, whereby an electrostatic latent image is formed on the surface of the drum 10 in a pattern of dots.

The electrostatic latent image thus formed is developed into a toner image by use of toner particles 14 carried by a developing roller 13. The toner particles 14 are retained in a hopper 15 and are fed out of the hopper 15 at a predetermined rate by means of a powder scattering roller 16 located beneath the open bottom of the hopper 15. The toner particles 14 fed out of the hopper 15 fall on the developing roller 13 through a guide duct 17. As the toner particles 14 fall through the guide duct 17, they are charged in negative polarity by means of a pair of charging electrodes 18. The residual toner particles 14 remaining on the surface of the developing roller 13 after the toner particles 14 on the developing roller 13 have been used for developing the electrostatic latent image are scraped off by a fixed brush 19 provided beneath the developing roller 13 in contact therewith and recovered in a container 20.

Under the image recording drum 10 is provided an intermediate image carrying medium in the form of a transfer belt 21. The toner image developed on the drum 10 is contact transferred to the transfer belt 21 and then is further transferred to a steel plate 32 by a gap transfer method. As the intermediate image carrying medium, there may be used a metallic drum or belt carrying a dielectric layer thereon. The transfer belt 21 employed in the embodiment of the invention as shown in the drawing is tensioned around six rollers 22 to 27 in the form of a hexagon. The first roller 22 is a driving roller which is driven by a motor 29 by way of a drive belt 28. Since the drive belt 28 is also tensioned around a pulley 30 of the recording drum 10, the transfer belt 21 and the recording drum 10 are rotated in synchronization with each other. Further, the elements of the drive system are selected so that the peripheral speed of the drum 10 is equal to that of the transfer belt 21. The drum 10 and the belt 21 and other rollers are rotated when a steel plate 32 is fed to the print marking station on feed rollers 31*a* to 31*g*. Arrival of the steel plate 32 at the print marking station is detected by a detecting means. Further, the transfer belt 21 is driven at the same speed as that at which the steel plate 32 is fed so that the surface of the transfer belt 21 carrying a toner image to be transferred to the steel plate 32 runs in parallel to and at the same speed as that of the surface of the steel plate 32.

The second roller 23 is a tension roller which is spring biased outwardly by means of a spring 33 to provide the transfer belt 21 with a constant tension. The third and fourth rollers 24 and 25 are movable up and down by means of a drive means (not shown) so that these rollers 24 and 25 move the transfer belt 21 close to the steel plate 32 only when the steel plate 32 passes thereunder and hold the same in an upper position when the steel plate 32 is not present at the print marking station.

The toner particles transferred to the transfer belt 21 are re-charged by a DC charger 34 provided in the vicinity of the path of the transfer belt 21. The space between the DC charger 34 and the surface of the transfer belt 21 is about 10 to 20 mm. The DC charger 34 is charged with a voltage of about 6 to 8 KV. After the toner particles are re-charged by the DC charger 34, they are gap-transferred to the steel plate 32 at the print marking station between the third and fourth rollers 24 and 25. In the course of the gap transfer, a part of the transfer belt 21 is imparted with an ultrasonic vibration from an ultrasonic vibrator 35. At the same time, a high voltage of about 8 to 10 KV is applied across the space between the transfer belt 21 and the steel plate 32 in the transfer station.

The toner particles remaining on the surface of the recording drum 10 after the toner image is transferred to the transfer belt 21 are removed by a rotary bush 36. The rotary brush 36 is provided within a casing 37 connected with a suction means so that the toner particles removed from the surface of the drum 10 by the brush 36 are sucked and covered through the casing 37. The electric charge carried by the recording drum 10 is then neutralized by an AC charger 38.

In operation of the above described embodiment of the present invention, the surface of the recording drum 10 is pre-charged by the DC charger 11 and then is charged imagewise by the set of discharge electrodes 12 in the form of a dotted pattern. Thus, an electrostatic latent image is formed on the surface of the image recording drum 10.

On the other hand, the toner particles 14 fed out of the hopper 15 are charged in negative polarity by the pair of charging electrodes 18 while the toner particles 14 fall through the guide duct 17. The charged toner particles 14 fall on the developing roller 13. As the developing roller 13 rotates, the toner particles 14 thereon are brought into contact with the surface of the image recording drum 10 which carries an electrostatic latent image and are transferred to the surface of the drum 10. The remaining toner particles are removed from the surface of the developing roller 13 by the fixed brush 19 and recovered in a container 20.

The electrostatic latent image is thus developed into a toner image and is then transferred to the transfer belt 21 by contact transfer. A high voltage of about 2 KV is applied across the drum 10 and the belt 21 when the toner image is transferred from the drum 10 to the belt 21. The transfer belt 21 is rotated in synchronization with the steel plate 32 fed to the print marking station on the feed rollers 31*a* to 31*g*. As the transfer belt 21 runs along the path around the six rollers 22 to 27, the toner image advances from a transfer station where the toner image is transferred from the drum 10 to the belt 21 to the print marking station where the toner image is transferred from the belt 21 to the steel plate 32. As the toner image advances from the transfer station to the print marking station, the toner image is uniformly re-charged by the DC charger 34. The toner image thus re-charged is transferred from the belt 21 to the steel plate 32 when the toner image passes through the print marking station between the third and fourth rollers 24 and 25. This transfer is a gap transfer conducted with the aid of vibration caused by the ultrasonic vibrator 35 and a high voltage applied across the space between the belt 21 and the steel plate 32. The transfer belt 21 is applied with a voltage at the print marking station of opposite polarity to the voltage applied thereto at the transfer station where the toner image is transferred from the image recording drum 10 to the transfer belt 21. Since the level of the voltage applied at the print marking station is high, the belt 21 is separated from the drum 10 while the toner image is transferred to the steel plate 32.

After the toner image has been transferred from the image recording drum 10 to the belt 21, the surface of the recording drum 10 is cleaned by the rotary brush 36 to remove the residual toner particles remaining on the surface of the recording drum 10. The surface charge carried by the drum 10 is then neutralized by the AC charger 38. Thus, one cycle of the print marking process is finished.

We claim:

1. An electrostatic print marking apparatus for printing markings on steel plates wherein an electrostatic latent image is developed into a toner image and the toner image is transferred to an intermediate image carrying medium, and the toner image transferred to the intermediate image carrying medium is transferred to a steel plate, wherein the improvement comprises a DC charger provided in the vicinity of said intermediate image carrying medium for re-charging the toner image carried on the intermediate image carrying medium before the toner is transferred to the steel plate in the same polarity as the polarity in which the toner image is charged before the toner image is transferred to the intermediate image carrying medium.

2. An electrostatic print marking apparatus as claimed in claim 1 wherein said intermediate image carrying medium is a flexible belt consisting of a metallic substrate and a dielectric layer provided thereon.

* * * * *